US009818334B2

(12) United States Patent
Jin et al.

(10) Patent No.: US 9,818,334 B2
(45) Date of Patent: Nov. 14, 2017

(54) DISPLAY SUBSTRATE AND METHOD FOR DRIVING THE SAME, AND DISPLAY APPARATUS

(71) Applicant: BOE TECHNOLOGY GROUP CO., LTD., Beijing (CN)

(72) Inventors: Xiaodan Jin, Beijing (CN); Lintao Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 5 days.

(21) Appl. No.: 14/905,468

(22) PCT Filed: Jul. 16, 2015

(86) PCT No.: PCT/CN2015/084217
§ 371 (c)(1),
(2) Date: Jan. 15, 2016

(87) PCT Pub. No.: WO2016/127571
PCT Pub. Date: Aug. 18, 2016

(65) Prior Publication Data

US 2016/0372020 A1 Dec. 22, 2016

(30) Foreign Application Priority Data

Feb. 13, 2015 (CN) ..... 2015 1 0079720

(51) Int. Cl.
*G09G 3/20* (2006.01)
*G09F 9/302* (2006.01)

(52) U.S. Cl.
CPC ..... *G09G 3/2003* (2013.01); *G09F 9/302* (2013.01); *G09G 3/20* (2013.01);
(Continued)

(58) Field of Classification Search
CPC ..... G09G 3/2003; G09G 3/20; G09G 3/3607; G09G 2300/0426; G09G 2300/0452;
(Continued)

(56) References Cited

U.S. PATENT DOCUMENTS

2003/0117423 A1* 6/2003 Brown Elliott ..... G09G 3/20 345/690
2004/0080479 A1* 4/2004 Credelle ..... G02F 1/133514 345/88

(Continued)

FOREIGN PATENT DOCUMENTS

CN 203085546 U 7/2013
CN 103700329 A 4/2014

(Continued)

OTHER PUBLICATIONS

International Search Report dated Nov. 3, 2015 corresponding to International application No. PCT/CN2015/084217.

*Primary Examiner* — Tom Sheng
(74) *Attorney, Agent, or Firm* — Nath, Goldberg & Meyer; Joshua B. Goldberg

(57) ABSTRACT

The present invention provides a display substrate and a method for driving the same, and a display apparatus. The display substrate comprises pixel groups repeatedly arranged, each of the pixel groups comprises two first sub-pixels, eight second sub-pixels and two third sub-pixels, and each of the pixel groups comprises four pixel columns, two first sub-pixels are sequentially arranged in a first pixel column of each of the pixel groups and two third sub-pixels are sequentially arranged in a third pixel column of each of the pixel groups, wherein, each of the first sub-pixels is disposed so as to correspond to two second sub-pixels in a pixel column adjacent thereto, and each of the third sub-
(Continued)

pixels is disposed so as to correspond to two second sub-pixels in a pixel column adjacent thereto.

14 Claims, 2 Drawing Sheets

(52) U.S. Cl.
CPC ..... *G09G 2300/0426* (2013.01); *G09G 2300/0452* (2013.01); *G09G 2300/0465* (2013.01)

(58) Field of Classification Search
CPC .... G09G 2300/0465; G09G 2300/0443; G09F 9/302; H01L 27/3211; H01L 27/3213; H01L 27/3216; H01L 27/3218
See application file for complete search history.

(56) References Cited

U.S. PATENT DOCUMENTS

2004/0246381 A1* 12/2004 Credelle ..... G09G 3/3614 348/692
2005/0001542 A1* 1/2005 Kiguchi ..... H01L 27/3216 313/504
2007/0091044 A1 4/2007 Park et al.
2007/0273626 A1* 11/2007 Kerofsky ..... G09G 3/3607 345/87
2010/0118045 A1* 5/2010 Brown Elliott .... G02B 27/2214 345/589
2010/0245224 A1 9/2010 Xu et al.
2011/0025669 A1* 2/2011 Kwak ..... G09G 3/3225 345/211
2011/0043500 A1* 2/2011 Kwak ..... G09G 3/006 345/206
2011/0128262 A1* 6/2011 Chaji ..... H01L 51/5271 345/205
2014/0002431 A1* 1/2014 Shibata ..... G09G 3/3614 345/208
2014/0354520 A1* 12/2014 Sato ..... G09G 3/3233 345/77
2015/0029208 A1* 1/2015 Kim ..... G09G 3/2003 345/590
2016/0148981 A1* 5/2016 Matsueda ..... H01L 27/3218 257/40
2016/0275858 A1* 9/2016 Wang ..... H01L 27/32
2016/0329385 A1* 11/2016 Qiu ..... H01L 27/3218
2016/0358540 A1* 12/2016 Jin ..... G09F 9/30
2016/0372019 A1* 12/2016 Jin ..... G09G 3/20

FOREIGN PATENT DOCUMENTS

CN 103714751 A 4/2014
CN 104037203 A 9/2014
CN 104050896 A 9/2014
CN 104123904 A 10/2014
CN 104166259 A 11/2014
CN 104166260 A 11/2014
CN 104238174 A 12/2014
CN 104616597 A 5/2015
JP 2008233454 A 10/2008

* cited by examiner

DISPLAY SUBSTRATE AND METHOD FOR DRIVING THE SAME, AND DISPLAY APPARATUS

This is a National Phase Application filed under 35 U.S.C. 371 as a national stage of PCT/CN2015/084217 filed on Jul. 16, 2015, an application claiming the benefit of Chinese Application No. 201510079720.6 filed on Feb. 13, 2015, the content of each of which is hereby incorporated by reference in its entirety.

FIELD OF THE INVENTION

The present invention relates to the field of display technology, in particular to a display substrate and a method for driving the same, and a display apparatus.

BACKGROUND OF THE INVENTION

Traditional display apparatus performs display by a pixel consisting of sub-pixels of three colors (i.e., red, green and blue, RGB). In practical applications, resolution of the display apparatus may be improved by increasing pixels per inch (PPI) of the display apparatus.

Currently, RG/BG is the most commonly used pixel arrangement which can achieve a high resolution with fewer sub-pixels. However, with increasing of requirement for the resolution of the display apparatus, the pixel arrangement of RG/BG is also facing a big challenge. This is because that, in order to increase the resolution of the display apparatus, the number of the sub-pixels is required to be increased, resulting in that the complexity of manufacturing process of the display apparatus is increased owing to the known manufacturing process, and the manufacturing cost will also be increased. Thus, in practical applications, it is difficult to meet the requirement of the larger resolution by the traditional RG/BG sub-pixel arrangement.

SUMMARY OF THE INVENTION

One object of the present invention is to provide a display substrate and a method for driving the same, and a display apparatus, for reducing the complexity of manufacturing process of the display apparatus and the manufacturing cost.

In order to achieve the above object, the present invention provides a display substrate, comprising pixel groups repeatedly arranged, each of the pixel groups comprises two first sub-pixels, eight second sub-pixels and two third sub-pixels, and each of the pixel groups comprises four pixel columns;

four second sub-pixels are sequentially arranged in a second pixel column of each of the pixel groups;

four second sub-pixels are sequentially arranged in a fourth pixel column of each of the pixel groups;

two first sub-pixels are sequentially arranged in a first pixel column of each of the pixel groups and two third sub-pixels are sequentially arranged in a third pixel column of each of the pixel groups, or one first sub-pixel and one third sub-pixel are sequentially arranged in the first pixel column of each of the pixel groups and one third sub-pixel and one first sub-pixel are sequentially arranged in the third pixel column of each of the pixel groups;

wherein, each of the first sub-pixels is disposed so as to correspond to two second sub-pixels in a pixel column adjacent thereto, each of the third sub-pixels is disposed so as to correspond to two second sub-pixels in a pixel column adjacent thereto.

Optionally, when two first sub-pixels are sequentially arranged in the first pixel column of each of the pixel groups and two third sub-pixels are sequentially arranged in the third pixel column of each of the pixel groups, the first one of the first sub-pixels in the first pixel column and the first one of the third sub-pixels in the third pixel column are in a same pixel row, the second one of the first sub-pixels in the first pixel column and the second one of the third sub-pixels in the third pixel column are in a same pixel row.

Optionally, a luminescence center of the first one of the first sub-pixels in the first pixel column and a middle point of a connecting line which connects luminescence centers of the first and second ones of the second sub-pixels in the second pixel column are on a same line in a row direction, a luminescence center of the first one of the third sub-pixels in the third pixel column and a middle point of a connecting line which connects luminescence centers of the first and second ones of the second sub-pixels in the fourth pixel column are on a same line in the row direction, a luminescence center of the second one of the first sub-pixels in the first pixel column and a middle point of a connecting line which connects luminescence centers of the third and fourth ones of the second sub-pixels in the second pixel column are on a same line in the row direction, a luminescence center of the second one of the third sub-pixels in the third pixel column and a middle point of a connecting line which connects luminescence centers of the third and fourth ones of the second sub-pixels in the fourth pixel column are on a same line in the row direction.

Optionally, when the first sub-pixel and the third sub-pixel are sequentially arranged in the first pixel column of each of the pixel groups and the third sub-pixel and the first sub-pixel are sequentially arranged in the third pixel column of each of the pixel groups, the first sub-pixel in the first pixel column and the third sub-pixel in the third pixel column are in a same pixel row, the third sub-pixel in the first pixel column and the first sub-pixel in the third pixel column are in a same pixel row.

Optionally, a luminescence center of the first sub-pixel in the first pixel column and a middle point of a connecting line which connects luminescence centers of the first and second ones of the second sub-pixels in the second pixel column are on a same line in the row direction, a luminescence center of the third sub-pixel in the third pixel column and a middle point of a connecting line which connects luminescence centers of the first and second ones of the second sub-pixels in the fourth pixel column are on a same line in the row direction, a luminescence center of the third sub-pixel in the first pixel column and a middle point of a connecting line which connects luminescence centers of the third and fourth ones of the second sub-pixels in the second pixel column are on a same line in the row direction, a luminescence center of the first sub-pixel in the third pixel column and a middle point of a connecting line which connects luminescence centers of the third and fourth ones of the second sub-pixels in the fourth pixel column are on a same line in the row direction.

In order to achieve the above object, the present invention also provides a display apparatus, comprising the above display substrate.

In order to achieve the above object, the present invention also provides a method for driving the above display substrate, the method comprising steps of:

generating output values of the two first sub-pixels in the first pixel column, the four second sub-pixels in the second pixel column, the two third sub-pixels in the third pixel column and the four second sub-pixels in the fourth pixel column of each of the pixel groups; outputting the output values of the two first sub-pixels in the first pixel column, the four second sub-pixels in the second pixel column, the two third sub-pixels in the third pixel column and the four second sub-pixels in the fourth pixel column of each of the pixel groups; or, generating output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups; outputting the output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups.

Optionally, the step of generating the output values of the two first sub-pixels in the first pixel column, the four second sub-pixels in the second pixel column, the two third sub-pixels in the third pixel column and the four second sub-pixels in the fourth pixel column of each of the pixel groups comprises sub-steps of:

generating the output value of each of the first sub-pixels in the first pixel column in accordance with four first sub-pixel input values corresponding to the first sub-pixel in the first pixel column;

generating the output value of each of the second sub-pixels in the second pixel column in accordance with a second sub-pixel input value corresponding to the second sub-pixel in the second pixel column;

generating the output value of each of the third sub-pixels in the third pixel column in accordance with four third sub-pixel input values corresponding to the third sub-pixel in the third pixel column;

generating the output value of each of the second sub-pixels in the fourth pixel column in accordance with a second sub-pixel input value corresponding to the second sub-pixel in the fourth pixel column.

Optionally, the sub-step of generating the output value of each of the first sub-pixels in the first pixel column in accordance with the four first sub-pixel input values corresponding to the first sub-pixel in the first pixel column comprises: dividing a sum of the four first sub-pixel input values corresponding to the first sub-pixel in the first pixel column by four to generate the output value of the first sub-pixel in the first pixel column;

the sub-step of generating the output value of each of the second sub-pixels in the second pixel column in accordance with the second sub-pixel input value corresponding to the second sub-pixel in the second pixel column comprises: setting the second sub-pixel input value corresponding to the second sub-pixel in the second pixel column as the output value of the second sub-pixel in the second pixel column;

the sub-step of generating the output value of each of the third sub-pixels in the third pixel column in accordance with the four third sub-pixel input values corresponding to the third sub-pixel in the third pixel column comprises: dividing a sum of the four third sub-pixel input values corresponding to the third sub-pixel in the third pixel column by four to generate the output value of the third sub-pixel in the third pixel column;

the sub-step of generating the output value of each of the second sub-pixels in the fourth pixel column in accordance with the second sub-pixel input value corresponding to the second sub-pixel in the fourth pixel column comprises: setting the second sub-pixel input value corresponding to the second sub-pixel in the fourth pixel column as the output value of the second sub-pixel in the fourth pixel column.

Optionally, the step of generating the output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups comprises sub-steps of:

generating the output value of the first sub-pixel in the first pixel column in accordance with four first sub-pixel input values corresponding to the first sub-pixel in the first pixel column;

generating the output value of the third sub-pixel in the first pixel column in accordance with four third sub-pixel input values corresponding to the third sub-pixel in the first pixel column;

generating the output value of each of the second sub-pixels in the second pixel column in accordance with the second sub-pixel input value corresponding to the second sub-pixel in the second pixel column;

generating the output value of the third sub-pixel in the third pixel column in accordance with four third sub-pixel input values corresponding to the third sub-pixel in the third pixel column;

generating the output value of the first sub-pixel in the third pixel column in accordance with four first sub-pixel input values corresponding to the first sub-pixel in the third pixel column;

generating the output value of each of the second sub-pixels in the fourth pixel column in accordance with the second sub-pixel input value corresponding to the second sub-pixel in the fourth pixel column.

Optionally, the sub-step of generating the output value of the first sub-pixel in the first pixel column in accordance with the four first sub-pixel input values corresponding to the first sub-pixel in the first pixel column comprises: dividing a sum of the four first sub-pixel input values corresponding to the first sub-pixel in the first pixel column by four to generate the output value of the first sub-pixel in the first pixel column;

the sub-step of generating the output value of the third sub-pixel in the first pixel column in accordance with the four third sub-pixel input values corresponding to the third sub-pixel in the first pixel column comprises: dividing a sum of the four third sub-pixel input values corresponding to the third sub-pixel in the first pixel column by four to generate the output value of the third sub-pixel in the first pixel column;

the sub-step of generating the output value of each of the second sub-pixels in the second pixel column in accordance with the second sub-pixel input value corresponding to the second sub-pixel in the second pixel column comprises: setting the second sub-pixel input value corresponding to the second sub-pixel in the second pixel column as the output value of the second sub-pixel in the second pixel column;

the sub-step of generating the output value of the third sub-pixel in the third pixel column in accordance with the four third sub-pixel input values corresponding to the third sub-pixel in the third pixel column comprises: dividing a sum of the four third sub-pixel input values corresponding to the third sub-pixel in the third pixel column by four to generate the output value of the third sub-pixel in the third pixel column;

the sub-step of generating the output value of the first sub-pixel in the third pixel column in accordance with the four first sub-pixel input values corresponding to the first sub-pixel in the third pixel column comprises: dividing a sum of the four first sub-pixel input values corresponding to the first sub-pixel in the third pixel column by four to generate the output value of the first sub-pixel in the third pixel column;

the sub-step of generating the output value of each of the second sub-pixels in the fourth pixel column in accordance with the second sub-pixel input value corresponding to the second sub-pixel in the fourth pixel column comprises: setting the second sub-pixel input value corresponding to the second sub-pixel in the fourth pixel column as the output value of the second sub-pixel in the fourth pixel column.

The present invention has the following beneficial effects.

In technical solutions of the display substrate and the method for driving the same, and the display apparatus of the present invention, each of the pixel groups comprises two first sub-pixels, eight second sub-pixels and two third sub-pixels, the two first sub-pixels are sequentially arranged in the first pixel column and the two third sub-pixels are sequentially arranged in the third pixel column; or the first sub-pixel and the third sub-pixel are sequentially arranged in the first pixel column and the third sub-pixel and the first sub-pixel are sequentially arranged in the third pixel column. Each of the first sub-pixels is disposed so as to correspond to two second sub-pixels in the pixel column adjacent thereto so that the first sub-pixel is commonly used by the two second sub-pixels, and each of the third sub-pixels is disposed so as to correspond to two second sub-pixels in the pixel column adjacent thereto so that the third sub-pixel is commonly used by the two second sub-pixels. The number of the first and third sub-pixels in each of the pixel groups is reduced in the present invention, thus the number of the sub-pixels in the whole display apparatus is reduced, thereby the complexity and the cost for manufacturing the display apparatus are reduced while ensuring a high resolution of the display apparatus.

DETAILED DESCRIPTION OF THE EMBODIMENTS

To make those skilled in the art better understand the technical solutions of the present invention, the display substrate and the method for driving the same, and the display apparatus of the present invention will be described below in detail with reference to the drawings.

Figure 1:
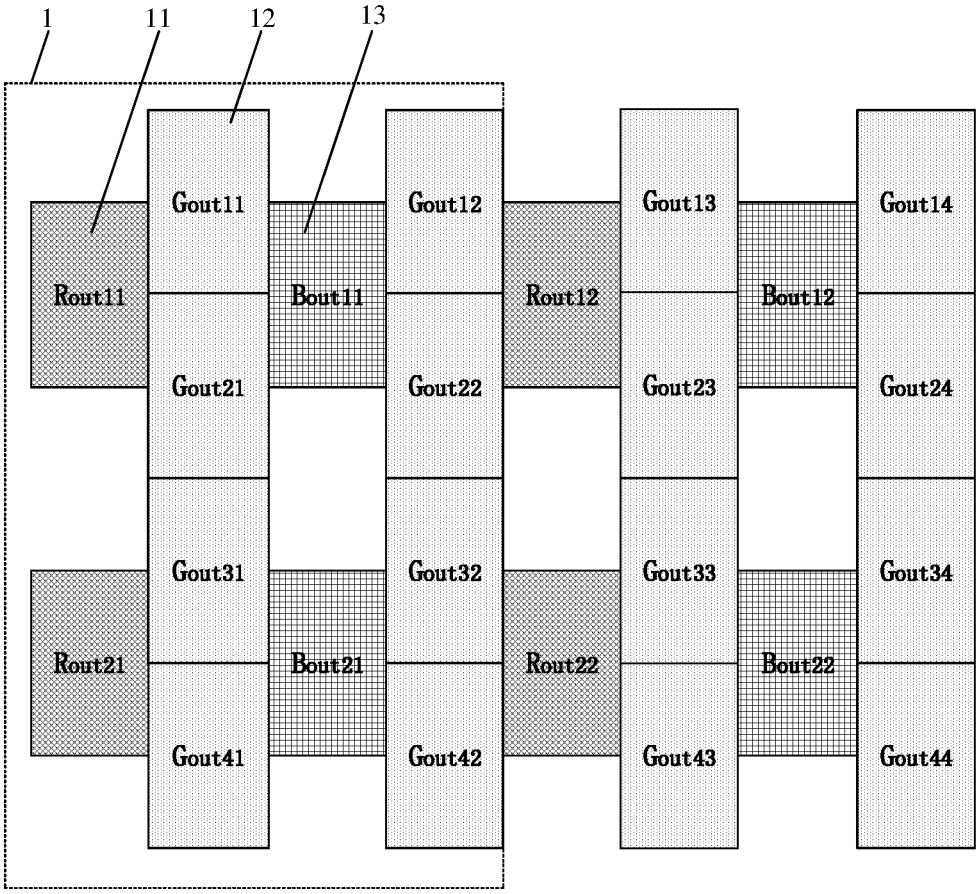
FIG. 1 is a structural diagram of a display substrate in a first embodiment of the present invention.

FIG. 1 is a structural diagram of a display substrate in a first embodiment of the present invention. As shown in FIG. 1, the display substrate comprises pixel groups 1 repeatedly arranged, each of the pixel groups 1 comprises two first sub-pixels 11, eight second sub-pixels 12 and two third sub-pixels 13, and each of the pixel groups 1 comprises four pixel columns sequentially arranged: a first pixel column comprising two first sub-pixels 11, a second pixel column comprising four second sub-pixels 12, a third pixel column comprising two third sub-pixels 13, and a fourth pixel column comprising four second sub-pixels 12. The four second sub-pixels 12 in the second pixel column of each of the pixel groups 1 are sequentially arranged; the four second sub-pixels 12 in the fourth pixel column of each of the pixel groups 1 are sequentially arranged; the two first sub-pixels 11 in the first pixel column of each of the pixel groups 1 are sequentially arranged and the two third sub-pixels 13 in the third pixel column of each of the pixel groups 1 are sequentially arranged. In the present embodiment, each of the first sub-pixels 11 is disposed so as to correspond to two second sub-pixels 12 in the pixel column adjacent thereto, and each of the third sub-pixels 13 is disposed so as to correspond to two second sub-pixels 12 in the pixel column adjacent thereto.

Specifically, as shown in FIG. 1, from up to down, the first one of the first sub-pixels 11 in the first pixel column is disposed so as to correspond to the first and second ones of the second sub-pixels 12 in the second pixel column; the second one of the first sub-pixels 11 in the first pixel column is disposed so as to correspond to the third and fourth ones of the second sub-pixels 12 in the second pixel column; the first one of the third sub-pixels 13 in the third pixel column is disposed so as to correspond to the first and second ones of the second sub-pixels 12 in the fourth pixel column; the second one of the third sub-pixels 13 in the third pixel column is disposed so as to correspond to the third and fourth ones of the second sub-pixels 12 in the fourth pixel column.

Preferably, the first one of the first sub-pixels 11 in the first pixel column and the first one of the third sub-pixels 13 in the third pixel column are in a same pixel row, the second one of the first sub-pixels 11 in the first pixel column and the second one of the third sub-pixels 13 in the third pixel column are in a same pixel row.

Preferably, a luminescence center of the first one of the first sub-pixels 11 in the first pixel column and a middle point of a connecting line which connects luminescence centers of the first and second ones of the second sub-pixels 12 in the second pixel column are on a same line in the row direction, a luminescence center of the first one of the third sub-pixels 13 in the third pixel column and a middle point of a connecting line which connects luminescence centers of the first and second ones of the second sub-pixels 12 in the fourth pixel column are on a same line in the row direction, a luminescence center of the second one of the first sub-pixels 11 in the first pixel column and a middle point of a connecting line which connects luminescence centers of the third and fourth ones of the second sub-pixels 12 in the second pixel column are on a same line in the row direction, a luminescence center of the second one of the third sub-pixels 13 in the third pixel column and a middle point of a connecting line which connects luminescence centers of the third and fourth ones of the second sub-pixels 12 in the fourth pixel column are on a same line in the row direction.

In the present embodiment, preferably, the first sub-pixel 11 is a red sub-pixel R, the second sub-pixel 12 is a green sub-pixel G, and the third sub-pixel 13 is a blue sub-pixel B, thereby the sub-pixels in the display substrate are arranged in RG/BG mode. In practical applications, the first sub-pixel 11, the second sub-pixel 12 and the third sub-pixel 13 also may be sub-pixels with other colors, which will not be enumerated one by one here.

The calculation method of output values of the sub-pixels in the display substrate of the present embodiment will be described below in detail by taking a specific example. In the present embodiment, as an example, the first sub-pixel 11 is the red sub-pixel R, the second sub-pixel 12 is the green sub-pixel G, and the third sub-pixel 13 is the blue sub-pixel B.

Since each of the pixel groups 1 comprises two first sub-pixels 11, eight second sub-pixels 12 and two third sub-pixels 13, the ratio of the numbers of R, G and B sub-pixles (R:G:B)=1:4:1. In the present embodiment, the total number of input values of input signals corresponding to all the sub-pixels in the display substrate is M×N×3 (wherein, M is a row resolution, N is a column resolution), that is, the input signals include M×N first sub-pixel input values, M×N second sub-pixel input values and M×N third sub-pixel input values. The display substrate has a replace ratio (RR) of 1.5 during displaying, thus the total number of output values of output signals corresponding to all the sub-pixels of the display substrate is M×N×3/2, wherein the replace ratio (RR) of 1.5 means that one pixel is represented by 1.5 sub-pixels during displaying. Since R:G:B=1:4:1, in the display substrate, the number of output values of the first sub-pixels 11 is M×N×3/2×1/6=M×N/4, the number of output values of the second sub-pixels 12 is M×N×3/2×4/6=M×N, and the number of output values of the third sub-pixels 13 is M×N×3/2×1/6=M×N/4.

As above, the number of output values of the first sub-pixels 11 is ¼ of the number of the first sub-pixel input values, the number of output values of the second sub-pixels 12 is equal to the number of the second sub-pixel input values, and the number of output values of the third sub-pixels 13 is ¼ of the number of the third sub-pixel input values. Based on the above conclusion, the output values of the sub-pixels are calculated by the following calculation method.

The output value of each of the first sub-pixels 11 in the first pixel column is obtained by dividing the sum of four first sub-pixel input values corresponding to the first sub-pixel 11 in the first pixel column by four, wherein, the four first sub-pixel input values corresponding to the output value $R_{outij}$ (wherein, i refers to the number of the row and 1≤i≤M; j refers to the number of the column and 1≤j≤N) of each of the first sub-pixels 11 are respectively $R_{in(2i-1,\ 2j-1)}$, $R_{in(2i-1,\ 2j)}$, $R_{in(2i,\ 2j-1)}$ and $R_{in(2i,\ 2j)}$ thus $R_{outij}=(R_{in(2i-1,\ 2j-1)}+R_{in(2i-1,\ 2j)}+R_{in(2i,\ 2j-1)}+R_{in(2i,\ 2j)})/4$. In the pixel group 1, the output value of the first one of the first sub-pixels 11 in the first pixel column is $R_{out11}=(R_{in11}+R_{in12}+R_{in(21}+R_{in22})/4$, the output value of the second one of the first sub-pixels 11 in the first pixel column is $R_{out21}=(R_{in31}+R_{in32}+R_{in41}+R_{in42})/4$, and the output values of the first sub-pixels 11 in the first pixel column of other pixel groups may be deduced by analogy, which will not be described in detail.

The output value of each of the second sub-pixels 12 in the second pixel column is equal to the second sub-pixel input value corresponding to the second sub-pixel 12 in the second pixel column, wherein, the second sub-pixel input value corresponding to the output value $G_{outij}$ of the second sub-pixel 12 is $G_{inij}$, that is, $G_{outij}=G_{inij}$ (wherein, i refers to the number of the row and 1≤i≤M; j refers to the number of the column and 1≤j≤N) In the pixel group 1, the output value of the first one of the second sub-pixels 12 in the second pixel column is $G_{out11}=G_{in11}$, the output value of the second one of the second sub-pixels 12 in the second pixel column is $G_{out21}=G_{in21}$, the output value of the third one of the second sub-pixels 12 in the second pixel column is $G_{out31}=G_{in31}$, the output value of the fourth one of the second sub-pixels 12 in the second pixel column is $G_{out41}=G_{in41}$. The output values of the second sub-pixels 12 in the second pixel column of other pixel groups may be deduced by analogy, which will not be described in detail.

The output value of each of the third sub-pixels 13 in the third pixel column is obtained by dividing the sum of four third sub-pixel input values corresponding to the third sub-pixel 13 in the third pixel column by four, wherein, the four third sub-pixel input values corresponding to the output value $B_{outij}$ (wherein, i refers to the number of the row and 1≤i≤M; j refers to the number of the column and 1≤j≤N) of the third sub-pixel 13 are respectively $B_{in(2i-1,\ 2j-1)}$, $B_{in(2i-1,\ 2j)}$, $B_{in(2i,\ 2j-1)}$ and $B_{in(2i,\ 2j)}$, thus $B_{outij}=(B_{in(2i-1,\ 2j-1)}+B_{in(2i-1,\ 2j)}+B_{in(2i,\ 2j-1)}+B_{in(2i,\ 2j)})/4$. In the pixel group 1, the output value of the first one of the third sub-pixels 13 in the third pixel column is $B_{out11}=(B_{in11}+B_{in12}+B_{in21}+B_{in22})/4$, the output value of the second one of the third sub-pixels 13 in the third pixel column is $B_{out21}=(B_{in31}+B_{in32}+B_{in41}+B_{in42})/4$, and the output values of the third sub-pixels 13 in other pixel groups may be deduced by analogy, which will not be described in detail.

The output value of each of the second sub-pixels 12 in the fourth pixel column is equal to the second sub-pixel input value corresponding to the second sub-pixel 12 in the fourth pixel column, wherein, the second sub-pixel input value corresponding to the output value $G_{outij}$ of the second sub-pixel 12 is $G_{inij}$, that is, $G_{outij}=G_{inij}$ (wherein, i refers to the number of the row and 1≤i≤M; j refers to the number of the column and 1≤j≤N). In the pixel group 1, the output value of the first one of the second sub-pixels 12 in the fourth pixel column is $G_{out12}=G_{in12}$, the output value of the second one of the second sub-pixels 12 in the fourth pixel column is $G_{out22}=G_{in22}$, the output value of the third one of the second sub-pixels 12 in the fourth pixel column is $G_{out32}=G_{in32}$ the output value of the fourth one of the second sub-pixels 12 in the fourth pixel column is $G_{out42}=G_{in42}$. The output values of the second sub-pixels 12 in the fourth pixel column of other pixel groups may be deduced by analogy, which will not be described in detail.

Compared with the RG/BG pixel arrangement mode in the prior art, in the RG/BG pixel arrangement mode of the display substrate of the present embodiment, the number of the second sub-pixels 12 is maintained, but the numbers of the first sub-pixels 11 and the third sub-pixels 13 are reduced. In the present embodiment, each of the first sub-pixels 11 corresponds to two second sub-pixels 12 in the pixel column adjacent thereto, so that the first sub-pixel 11 is commonly used by the two second sub-pixels 12, and thereby the RG/BG pixel arrangement mode is formed while the number of the first sub-pixels 11 is reduced; each of the third sub-pixels 13 corresponds to two second sub-pixels 12 in the pixel column adjacent thereto, so that the third sub-pixel 13 is commonly used by the two second sub-pixels 12, and thereby the RG/BG pixel arrangement mode is formed while the number of the third sub-pixels 13 is reduced.

In practical applications, image analog display tests and black and white line display tests are performed on the display substrate of the present embodiment, and the result shows that, the display substrate of the present embodiment has a high resolution. Thus, in the present embodiment, although the numbers of the first sub-pixels and the third sub-pixels are reduced, a high resolution still can be obtained by cooperation of the above corresponding calculation method. Since the numbers of the first sub-pixels and the third sub-pixels (i.e., the red sub-pixels and the blue sub-pixels) are reduced in the present embodiment, the display quality for an image mainly based on red and blue colors will be reduced to some extent. Thus, the display substrate of the present embodiment is especially suitable for display apparatuses with super high resolution. When the display substrate of the present embodiment is applied for the display apparatus with super high resolution, influences caused by reduction of part of sub-pixels are reduced.

In technical solutions of the display substrate of the present embodiment, each of the pixel groups 1 comprises two first sub-pixels 11, eight second sub-pixels 12 and two third sub-pixels 13, the two first sub-pixels 11 are sequentially arranged in the first pixel column and the two third sub-pixels 13 are sequentially arranged in the third pixel column. Each of the first sub-pixels 11 is disposed so as to correspond to two second sub-pixels 12 in the pixel column adjacent thereto so that the first sub-pixel 11 is commonly used by the two second sub-pixels 12, each of the third sub-pixels 13 is disposed so as to correspond to two second sub-pixels 12 in the pixel column adjacent thereto so that the third sub-pixel 13 is commonly used by the two second sub-pixels 12. The number of the first sub-pixels 11 and the third sub-pixels 13 in each of the pixel groups is reduced in the present embodiment, thus the number of the sub-pixels in the whole display apparatus is reduced, the complexity and the cost for manufacturing the display apparatus are reduced while ensuring a high resolution of the display apparatus.

Figure 2:
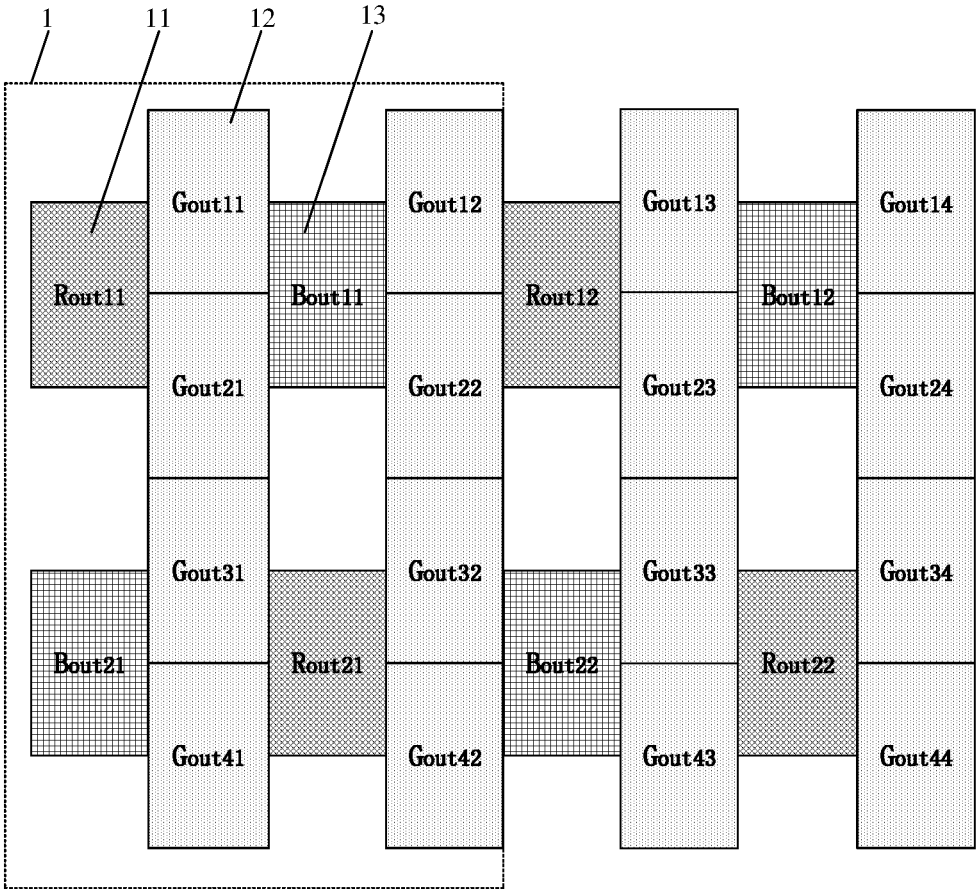
FIG. 2 is a structural diagram of a display substrate in a second embodiment of the present invention.

FIG. 2 is a structural diagram of a display substrate in a second embodiment of the present invention. As shown in FIG. 2, the display substrate comprises pixel groups 1 repeatedly arranged, each of the pixel groups 1 comprises two first sub-pixels 11, eight second sub-pixels 12 and two third sub-pixels 13, and each of the pixel groups 1 comprises four pixel columns: a first pixel column comprising one first sub-pixel 11 and one third sub-pixel 13, a second pixel column comprising four second sub-pixels 12, a third pixel column comprising one third sub-pixel 13 and one first sub-pixel 11, and a fourth pixel column comprising four second sub-pixels 12. The four second sub-pixels 12 in the second pixel column of each of the pixel groups 1 are sequentially arranged; the four second sub-pixels 12 in the fourth pixel column of each of the pixel groups 1 are sequentially arranged; the first sub-pixel 11 and the third sub-pixel 13 in the first pixel column of each of the pixel groups 1 are sequentially arranged; and the third sub-pixel 13 and the first sub-pixel 11 in the third pixel column of each of the pixel groups 1 are sequentially arranged. Each of the first sub-pixels 11 is disposed so as to correspond to two second sub-pixels 12 in the pixel column adjacent thereto, and each of the third sub-pixels 13 is disposed so as to correspond to two second sub-pixels 12 in the pixel column adjacent thereto.

Specifically, as shown in FIG. 2, from up to down, the first sub-pixel 11 in the first pixel column is disposed so as to correspond to the first and second ones of the second sub-pixels 12 in the second pixel column; the third sub-pixel 13 in the first pixel column is disposed so as to correspond to the third and fourth ones of the second sub-pixels 12 in the second pixel column; the third sub-pixel 13 in the third pixel column is disposed so as to correspond to the first and second ones of the second sub-pixels 12 in the fourth pixel column; the first sub-pixel 11 in the third pixel column is disposed so as to correspond to the third and fourth ones of the second sub-pixels 12 in the fourth pixel column.

Preferably, the first sub-pixel 11 in the first pixel column and the third sub-pixel 13 in the third pixel column are in a same pixel row, the third sub-pixel 13 in the first pixel column and the first sub-pixel 11 in the third pixel column are in a same pixel row.

Preferably, a luminescence center of the first sub-pixel 11 in the first pixel column and a middle point of a connecting line which connects luminescence centers of the first and second ones of the second sub-pixels 12 in the second pixel column are on a same line in the row direction, a luminescence center of the third sub-pixel 13 in the third pixel column and a middle point of a connecting line which connects luminescence centers of the first and second ones of the second sub-pixels 12 in the fourth pixel column are on a same line in the row direction, a luminescence center of the third sub-pixel 13 in the first pixel column and a middle point of a connecting line which connects luminescence centers of the third and fourth ones of the second sub-pixels 12 in the second pixel column are on a same line in the row direction, a luminescence center of the first sub-pixel 11 in the third pixel column and a middle point of a connecting line which connects luminescence centers of the third and fourth ones of the second sub-pixels 12 in the fourth pixel column are on a same line in the row direction.

In the present embodiment, preferably, the first sub-pixel 11 is a red sub-pixel R, the second sub-pixel 12 is a green sub-pixel G, and the third sub-pixel 13 is a blue sub-pixel B, thereby the sub-pixels in the display substrate are arranged in RG/BG mode. In practical applications, the first sub-pixel 11, the second sub-pixel 12 and the third sub-pixel 13 also may be sub-pixels with other colors, which will not be enumerated one by one here.

The calculation method of output values of the sub-pixels in the display substrate of the present embodiment will be described below in detail by taking a specific example. In the present embodiment, as an example, the first sub-pixel 11 is the red sub-pixel R, the second sub-pixel 12 is the green sub-pixel G, and the third sub-pixel 13 is the blue sub-pixel B.

Since each of the pixel groups 1 comprises two first sub-pixels 11, eight second sub-pixels 12 and two third sub-pixels 13, the ratio of the numbers of R, G and B sub-pixles (R:G:B)=1:4:1. In the present embodiment, the total number of input values of input signals corresponding to all the sub-pixels in the display substrate is M×N×3 (wherein, M is a row resolution, N is a column resolution), that is, the input signals include M×N first sub-pixel input values, M×N second sub-pixel input values and M×N third sub-pixel input values. The display substrate has a replace ratio (RR) of 1.5 during displaying, thus the total number of output values of output signals corresponding to all the sub-pixels of the display substrate is M×N×3/2, wherein the replace ratio (RR) of 1.5 means that one pixel is represented by 1.5 sub-pixels during displaying. Since R:G:B=1:4:1, in the display substrate, the number of output values of the first sub-pixels 11 is M×N×3/2×1/6=M×N/4, the number of output values of the second sub-pixels 12 is M×N×3/2×4/6=M×N, and the number of output values of the third sub-pixels 13 is M×N×3/2×1/6=M×N/4.

As above, the number of output values of the first sub-pixels 11 is ¼ of the number of the first sub-pixel input values, the number of output values of the second sub-pixels 12 is equal to the number of the second sub-pixel input values, and the number of output values of the third sub-pixels 13 is ¼ of the number of the third sub-pixel input values. Based on the above conclusion, the output values of the sub-pixels are calculated by the following calculation method.

The output value of the first sub-pixel 11 in the first pixel column is obtained by dividing the sum of four first sub-pixel input values corresponding to the first sub-pixel 11 in the first pixel column by four, wherein, the four first sub-pixel input values corresponding to the output value $R_{outij}$ (wherein, i refers to the number of the row and $1 \le i \le M$; j refers to the number of the column and $1 \le j \le N$) of the first sub-pixel 11 are respectively $R_{in(2i-1,\ 2j-1)}$, $R_{in(2i-1,\ 2j)}$, $R_{in(2i,\ 2j-1)}$ and $R_{in(2i,\ 2j)}$, thus $R_{outij}=(R_{in(2i-1,\ 2j-1)}+R_{in(2i-1,\ 2j)}+R_{in(2i,\ 2j-1)}+R_{in(2i,\ 2j)})/4$. In the pixel group 1, the output value of the first sub-pixel 11 in the first pixel column is $R_{out11}=(R_{in11}+R_{in12}+R_{in21}+R_{in22})/4$. The output value of the third sub-pixel 13 in the first pixel column is obtained by dividing the sum of four third sub-pixel input values corresponding to the third sub-pixel 13 in the first pixel column by four, wherein, the four third sub-pixel input values corresponding to the output value $B_{outij}$ (wherein, i refers to the number of the row and $1 \le i \le M$; j refers to the number of the column and $1 \le j \le N$) of the third sub-pixel 13 are respectively $B_{in(2i-1,\ 2j-1)}$, $B_{in(2i-1,\ 2j)}$, $B_{in(2i,\ 2j-1)}$ and $B_{in(2i,\ 2j)}$, thus $B_{outij}=(B_{in(2i-1,\ 2j-1)}+B_{in(2i-1,\ 2j)}+B_{in(2i,\ 2j-1)}+B_{in(2i,\ 2j)})/4$. In the pixel group 1, the output value of the third sub-pixel 13 in the first pixel column is $B_{out21}=(B_{in31}+B_{in32}+B_{in41}+B_{in42})/4$, and the output values of the sub-pixels in the first pixel column of other pixel groups may be deduced by analogy, which will not be described in detail.

The output value of each of the second sub-pixels 12 in the second pixel column is equal to the second sub-pixel input value corresponding to the second sub-pixel 12 in the second pixel column, wherein, the second sub-pixel input value corresponding to the output value $G_{outij}$ of the second sub-pixel 12 is $G_{inij}$, that is, $G_{outij}=G_{inij}$ (wherein, i refers to the number of the row and $1 \le i \le M$; j refers to the number of the column and $1 \le j \le N$). In the pixel group 1, the output value of the first one of the second sub-pixels 12 in the second pixel column is $G_{out11}=G_{in11}$, the output value of the second one of the second sub-pixels 12 in the second pixel column is $G_{out21}=G_{in21}$, the output value of the third one of the second sub-pixels 12 in the second pixel column is $G_{out31}=G_{in31}$, the output value of the fourth one of the second sub-pixels 12 in the second pixel column is $G_{out41}=G_{in41}$. The output values of the second sub-pixels 12 in the second pixel column of other pixel groups may be deduced by analogy, which will not be described in detail.

The output value of the third sub-pixel 13 in the third pixel column is obtained by dividing the sum of four third sub-pixel input values corresponding to the third sub-pixel 13 in the third pixel column by four, wherein, the four third sub-pixel input values corresponding to the output value $B_{outij}$ (wherein, i refers to the number of the row and $1 \le i \le M$; j refers to the number of the column and $1 \le j \le N$) of the third sub-pixel 13 are respectively $B_{in(2i-1,\ 2j-1)}$, $B_{in(2i-1,\ 2j)}$, $B_{in(2i,\ 2j-1)}$ and $B_{in(2i,\ 2j)}$, thus $B_{outij}=(B_{in(2i-1,\ 2j-1)}+B_{in(2i-1,\ 2j)}+B_{in(2i,\ 2j-1)}+B_{in(2i,\ 2j)})/4$. In the pixel group 1, the output value of the third sub-pixel 13 in the third pixel column is $B_{out11}=B_{in11}+B_{in12}+B_{in21}+B_{in22}/4$. The output value of the first sub-pixel 11 in the third pixel column is obtained by dividing the sum of four first sub-pixel input values corresponding to the first sub-pixel 11 in the third pixel column by four, wherein, the four first sub-pixel input values corresponding to the output value $R_{outij}$ (wherein, i refers to the number of the row and $1 \le i \le M$; j refers to the number of the column and $1 \le j \le N$) of the first sub-pixel 11 are respectively $R_{in(2i-1,\ 2j-1)}$, $R_{in(2i-1,\ 2j)}$, $R_{in(2i,\ 2j-1)}$ and $R_{in(2i,\ 2j)}$, thus $R_{outij}=R_{in(2i-1,\ 2j-1)}+R_{in(2i-1,\ 2j)}+R_{in(2i,\ 2j-1)}+R_{in(2i,\ 2j)})/4$. In the pixel group 1, the output value of the first sub-pixel 11 in the third pixel column is $R_{out21}=(R_{in31}+R_{in32}+R_{in41}+R_{in42})/4$. The output values of the sub-pixels in the third pixel column of other pixel groups may be deduced by analogy, which will not be described in detail.

The output value of each of the second sub-pixels 12 in the fourth pixel column is equal to the second sub-pixel input value corresponding to the second sub-pixel 12 in the fourth pixel column, wherein, the second sub-pixel input value corresponding to the output value $G_{outij}$ of the second sub-pixel 12 is $G_{inij}$, that is, $G_{outij}=G_{inij}$ (wherein, i refers to the number of the row and $1 \le i \le M$; j refers to the number of the column and $1 \le j \le N$). In the pixel group 1, the output value of the first one of the second sub-pixels 12 in the fourth pixel column is $G_{out12}=G_{in12}$, the output value of the second one of the second sub-pixels 12 in the fourth pixel column is $G_{out22}=G_{in22}$, the output value of the third one of the second sub-pixels 12 in the fourth pixel column is $G_{out32}=G_{in32}$, the output value of the fourth one of the second sub-pixels 12 in the fourth pixel column is $G_{out42}=G_{in42}$. The output values of the second sub-pixels 12 in the fourth pixel column of other pixel groups may be deduced by analogy, which will not be described in detail.

Compared with the RG/BG pixel arrangement mode in the prior art, in the RG/BG pixel arrangement mode of the display substrate of the present embodiment, the number of the second sub-pixels 12 is maintained, but the numbers of the first sub-pixels 11 and the third sub-pixels 13 are reduced. In the present embodiment, each of the first sub-pixels 11 corresponds to two second sub-pixels 12 in the pixel column adjacent thereto, so that the first sub-pixel 11 is commonly used by the two second sub-pixels 12, and thereby the RG/BG pixel arrangement mode is formed while the number of the first sub-pixels 11 is reduced; each of the third sub-pixels 13 corresponds to two second sub-pixels 12 in the pixel column adjacent thereto, so that the third sub-pixel 13 is commonly used by the two second sub-pixels 12, and thereby the RG/BG pixel arrangement mode is formed while the number of the third sub-pixels 13 is reduced.

In practical applications, image analog display tests and black and white line display tests are performed on the display substrate of the present embodiment, and the result shows that, the display substrate of the present embodiment has a high resolution. Thus, in the present embodiment, although the numbers of the first sub-pixels and the third sub-pixels are reduced, a high resolution still can be obtained by cooperation of the above corresponding calculation method. Since the numbers of the first sub-pixels and the third sub-pixels (i.e., the red sub-pixels and the blue sub-pixels) are reduced in the present embodiment, the display quality for an image mainly based on red and blue colors will be reduced to some extent. Thus, the display substrate of the present embodiment is especially suitable for display apparatuses with super high resolution. When the display substrate of the present embodiment is applied for the display apparatus with super high resolution, influences caused by reduction of part of sub-pixels are reduced.

In technical solutions of the display substrate of the present embodiment, each of the pixel groups 1 comprises two first sub-pixels 11, eight second sub-pixels 12 and two third sub-pixels 13, the first sub-pixel 11 and the third sub-pixel 13 are sequentially arranged in the first pixel column and the third sub-pixel 13 and the first sub-pixel 11 are sequentially arranged in the third pixel column. Each of the first sub-pixels 11 is disposed so as to correspond to two second sub-pixels 12 in the pixel column adjacent thereto so that the first sub-pixel 11 is commonly used by the two second sub-pixels 12, each of the third sub-pixels 13 is disposed so as to correspond to two second sub-pixels 12 in the pixel column adjacent thereto so that the third sub-pixel 13 is commonly used by the two second sub-pixels 12. The number of the first sub-pixels 11 and the third sub-pixels 13 in each of the pixel groups is reduced in the present embodiment, thus the number of the sub-pixels in the whole display apparatus is reduced, the complexity and the cost for manufacturing the display apparatus are reduced while ensuring a high resolution of the display apparatus. Compared with the display substrate in the first embodiment, the first sub-pixel 11 and the third sub-pixel 13 in any pixel row are arranged symmetrically, so that the display state is more symmetrically, the display effect is improved.

The Embodiments and the corresponding drawings of the present invention are described and illustrated by taking the vertical (up and down) direction being the column direction as the example, but without loss of generality, the object of the present invention also can be achieved by taking the transverse direction as the column direction, which also falls into the scope of the present invention.

A third embodiment of the present invention provides a display apparatus comprising a display substrate, wherein, the display substrate may be the display substrate of the first embodiment or the second embodiment, which will not be repeatedly described here.

In the present embodiment, the display apparatus may include a liquid crystal display apparatus or an organic light emitting diode (OLED) display apparatus.

In technical solutions of the display apparatus of the present embodiment, each of the pixel groups comprises two first sub-pixels 11, eight second sub-pixels 12 and two third sub-pixels 13, the two first sub-pixels 11 are sequentially arranged in the first pixel column and the two third sub-pixels 13 are sequentially arranged in the third pixel column; or the first sub-pixel 11 and the third sub-pixel 13 are sequentially arranged in the first pixel column and the third sub-pixel 13 and the first sub-pixel 11 are sequentially arranged in the third pixel column Each of the first sub-pixels 11 is disposed so as to correspond to two second sub-pixels 12 in the pixel column adjacent thereto so that the first sub-pixel 11 is commonly used by the two second sub-pixels 12, each of the third sub-pixels 13 is disposed so as to correspond to two second sub-pixels 12 in the pixel column adjacent thereto so that the third sub-pixel 13 is commonly used by the two second sub-pixels 12. The number of the first sub-pixels 11 and the third sub-pixels 13 in each of the pixel groups is reduced in the present embodiment, thus the number of the sub-pixels in the whole display apparatus is reduced, the complexity and the cost for manufacturing the display apparatus are reduced while ensuring a high resolution of the display apparatus.

A fourth embodiment of the present invention provides a method for driving a display substrate, the method may be used for driving the display substrate in the first embodiment, and the method comprises steps 101 through 102.

Step 101, generating output values of the two first sub-pixels in the first pixel column, the four second sub-pixels in the second pixel column, the two third sub-pixels in the third pixel column and the four second sub-pixels in the fourth pixel column of each of the pixel groups.

Step 102, outputting the output values of the two first sub-pixels in the first pixel column, the four second sub-pixels in the second pixel column, the two third sub-pixels in the third pixel column and the four second sub-pixels in the fourth pixel column of each of the pixel groups.

In the present embodiment, the step 101 specifically comprises sub-steps 1011 through 1014.

Sub-step 1011, generating the output value of each of the first sub-pixels in the first pixel column in accordance with four first sub-pixel input values corresponding to the first sub-pixel in the first pixel column.

Specifically, the output value of each of the first sub-pixels in the first pixel column is generated by dividing a sum of the four first sub-pixel input values corresponding to the first sub-pixel in the first pixel column by four.

Sub-step 1012, generating the output value of each of the second sub-pixels in the second pixel column in accordance with a second sub-pixel input value corresponding to the second sub-pixel in the second pixel column.

Specifically, the second sub-pixel input value corresponding to each of the second sub-pixels in the second pixel column is set as the output value of the second sub-pixel in the second pixel column.

Sub-step 1013, generating the output value of each of the third sub-pixels in the third pixel column in accordance with four third sub-pixel input values corresponding to the third sub-pixel in the third pixel column.

Specifically, the output value of each of the third sub-pixels in the third pixel column is generated by dividing a sum of the four third sub-pixel input values corresponding to the third sub-pixel in the third pixel column by four.

Sub-step 1014, generating the output value of each of the second sub-pixels in the fourth pixel column in accordance with a second sub-pixel input value corresponding to the second sub-pixel in the fourth pixel column.

Specifically, the second sub-pixel input value corresponding to each of the second sub-pixels in the fourth pixel column is set as the output value of the second sub-pixel in the fourth pixel column.

The sequence of the sub-steps 1011 through 1014 may be changed arbitrarily, or the sub-steps 1011 through 1014 may be performed simultaneously, which will not be limited here.

The method for driving a display substrate in the present embodiment is used for driving the display substrate in the first embodiment, and the specific description of the display substrate may refer to the first embodiment.

In technical solutions of the display substrate driven by the method for driving a display substrate in the present embodiment, each of the pixel groups comprises two first sub-pixels, eight second sub-pixels and two third sub-pixels, the two first sub-pixels are sequentially arranged in the first pixel column and the two third sub-pixels are sequentially arranged in the third pixel column Each of the first sub-pixels is disposed so as to correspond to two second sub-pixels in the pixel column adjacent thereto so that the first sub-pixel is commonly used by the two second sub-pixels, each of the third sub-pixels is disposed so as to correspond to two second sub-pixels in the pixel column adjacent thereto so that the third sub-pixel is commonly used by the two second sub-pixels. The number of the first sub-pixels and the third sub-pixels in each of the pixel groups is reduced in the present embodiment, thus the number of the sub-pixels in the whole display apparatus is reduced, the complexity and the cost for manufacturing the display apparatus are reduced while ensuring a high resolution of the display apparatus.

A fifth embodiment of the present invention provides a method for driving a display substrate, the method may be used for driving the display substrate in the second embodiment, and the method comprises steps 201 through 202.

Step 201, generating output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups.

Step 202, outputting the output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups.

In the present embodiment, the step 201 specifically comprises sub-steps 2011 through 2016.

Sub-step 2011, generating the output value of the first sub-pixel in the first pixel column in accordance with four first sub-pixel input values corresponding to the first sub-pixel in the first pixel column.

Specifically, the output value of the first sub-pixel in the first pixel column is generated by dividing a sum of the four first sub-pixel input values corresponding to the first sub-pixel in the first pixel column by four.

Sub-step 2012, generating the output value of the third sub-pixel in the first pixel column in accordance with four third sub-pixel input values corresponding to the third sub-pixel in the first pixel column.

Specifically, the output value of the third sub-pixel in the first pixel column is generated by dividing a sum of the four third sub-pixel input values corresponding to the third sub-pixel in the first pixel column by four.

Sub-step 2013, generating the output value of each of the second sub-pixels in the second pixel column in accordance with a second sub-pixel input value corresponding to the second sub-pixel in the second pixel column.

Specifically, the second sub-pixel input value corresponding to each of the second sub-pixels in the second pixel column is set as the output value of the second sub-pixel in the second pixel column.

Sub-step 2014, generating the output value of the third sub-pixel in the third pixel column in accordance with four third sub-pixel input values corresponding to the third sub-pixel in the third pixel column.

Specifically, the output value of the third sub-pixel in the third pixel column is generated by dividing a sum of the four third sub-pixel input values corresponding to the third sub-pixel in the third pixel column by four.

Sub-step 2015, generating the output value of the first sub-pixel in the third pixel column in accordance with four first sub-pixel input values corresponding to the first sub-pixel in the third pixel column.

Specifically, the output value of the first sub-pixel in the third pixel column is generated by dividing a sum of the four first sub-pixel input values corresponding to the first sub-pixel in the third pixel column by four.

Sub-step 2016, generating the output value of each of the second sub-pixels in the fourth pixel column in accordance with a second sub-pixel input value corresponding to the second sub-pixel in the fourth pixel column.

Specifically, the second sub-pixel input value corresponding to each of the second sub-pixels in the fourth pixel column is set as the output value of the second sub-pixel in the fourth pixel column.

The sequence of the sub-steps 2011 through 2016 may be changed arbitrarily, or the sub-steps 2011 through 2016 may be performed simultaneously, which will not be limited here.

The method for driving a display substrate in the present embodiment is used for driving the display substrate in the second embodiment, and the specific description of the display substrate may refer to the second embodiment.

In technical solutions of the display substrate driven by the method for driving a display substrate in the present embodiment, each of the pixel groups comprises two first sub-pixels, eight second sub-pixels and two third sub-pixels, the first sub-pixel and the third sub-pixel are sequentially arranged in the first pixel column and the third sub-pixel and the first sub-pixel are sequentially arranged in the third pixel column. Each of the first sub-pixels is disposed so as to correspond to two second sub-pixels in the pixel column adjacent thereto so that the first sub-pixel is commonly used by the two second sub-pixels, each of the third sub-pixels is disposed so as to correspond to two second sub-pixels in the pixel column adjacent thereto so that the third sub-pixel is commonly used by the two second sub-pixels. The number of the first sub-pixels and the third sub-pixels in each of the pixel groups is reduced in the present embodiment, thus the number of the sub-pixels in the whole display apparatus is reduced, the complexity and the cost for manufacturing the display apparatus are reduced while ensuring a high resolution of the display apparatus.

It should be understood that the foregoing embodiments are merely exemplary embodiments used for describing the principle of the present invention, and the present invention is not limited thereto. A person having ordinary skill in the art may make various variations and improvements to the present invention without departing from the spirit and essence of the present invention, and these variations and improvements shall fall into the protection scope of the present invention.

The invention claimed is:

1. A display substrate, comprising pixel groups repeatedly arranged, each of the pixel groups comprises two first sub-pixels, eight second sub-pixels and two third sub-pixels, and each of the pixel groups comprises four pixel columns;

four second sub-pixels are sequentially arranged in a second pixel column of each of the pixel groups;

four second sub-pixels are sequentially arranged in a fourth pixel column of each of the pixel groups;

two first sub-pixels are sequentially arranged in a first pixel column of each of the pixel groups and two third sub-pixels are sequentially arranged in a third pixel column of each of the pixel groups;

wherein each of the first sub-pixels is disposed so as to correspond to two second sub-pixels in a pixel column adjacent thereto, each of the third sub-pixels is disposed so as to correspond to two second sub-pixels in a pixel column adjacent thereto; and wherein a luminescence center of the first one of the first sub-pixels in the first pixel column and a middle point of a connecting line which connects luminescence centers of the first and second ones of the second sub-pixels in the second pixel column are on a same line in a row direction, a luminescence center of the first one of the third sub-pixels in the third pixel column and a middle point of a connecting line which connects luminescence centers of the first and second ones of the second sub-pixels in the fourth pixel column are on a same line in the row direction, a luminescence center of the second one of the first sub-pixels in the first pixel column and a middle point of a connecting line which connects luminescence centers of the third and fourth ones of the second sub-pixels in the second pixel column are on a same line in the row direction, a luminescence center of the second one of the third sub-pixels in the third pixel column and a middle point of a connecting line which connects luminescence centers of the third and fourth ones of the second sub-pixels in the fourth pixel column are on a same line in the row direction.

2. The display substrate of claim 1, wherein when two first sub-pixels are sequentially arranged in the first pixel column of each of the pixel groups and two third sub-pixels are sequentially arranged in the third pixel column of each of the pixel groups, the first one of the first sub-pixels in the first pixel column and the first one of the third sub-pixels in the third pixel column are in a same pixel row, the second one of the first sub-pixels in the first pixel column and the second one of the third sub-pixels in the third pixel column are in a same pixel row.

3. A display apparatus, comprising the display substrate of claim 2.

4. A display apparatus, comprising the display substrate of claim 1.

5. A method for driving the display substrate of claim 1, the method comprising steps of:

generating output values of the two first sub-pixels in the first pixel column, the four second sub-pixels in the second pixel column, the two third sub-pixels in the third pixel column and the four second sub-pixels in the fourth pixel column of each of the pixel groups; outputting the output values of the two first sub-pixels in the first pixel column, the four second sub-pixels in the second pixel column, the two third sub-pixels in the third pixel column and the four second sub-pixels in the fourth pixel column of each of the pixel groups.

6. The method of claim 5, wherein the step of generating the output values of the two first sub-pixels in the first pixel column, the four second sub-pixels in the second pixel column, the two third sub-pixels in the third pixel column and the four second sub-pixels in the fourth pixel column of each of the pixel groups comprises sub-steps of:

generating the output value of each of the first sub-pixels in the first pixel column in accordance with four first sub-pixel input values corresponding to the first sub-pixel in the first pixel column;

generating the output value of each of the second sub-pixels in the second pixel column in accordance with a second sub-pixel input value corresponding to the second sub-pixel in the second pixel column;

generating the output value of each of the third sub-pixels in the third pixel column in accordance with four third sub-pixel input values corresponding to the third sub-pixel in the third pixel column;

generating the output value of each of the second sub-pixels in the fourth pixel column in accordance with a second sub-pixel input value corresponding to the second sub-pixel in the fourth pixel column.

7. The method of claim 6, wherein, the sub-step of generating the output value of each of the first sub-pixels in the first pixel column in accordance with the four first sub-pixel input values corresponding to the first sub-pixel in the first pixel column comprises: dividing a sum of the four first sub-pixel input values corresponding to the first sub-pixel in the first pixel column by four to generate the output value of the first sub-pixel in the first pixel column;

the sub-step of generating the output value of each of the second sub-pixels in the second pixel column in accordance with the second sub-pixel input value corresponding to the second sub-pixel in the second pixel column comprises: setting the second sub-pixel input value corresponding to the second sub-pixel in the second pixel column as the output value of the second sub-pixel in the second pixel column;

the sub-step of generating the output value of each of the third sub-pixels in the third pixel column in accordance with the four third sub-pixel input values corresponding to the third sub-pixel in the third pixel column comprises: dividing a sum of the four third sub-pixel input values corresponding to the third sub-pixel in the third pixel column by four to generate the output value of the third sub-pixel in the third pixel column;

the sub-step of generating the output value of each of the second sub-pixels in the fourth pixel column in accordance with the second sub-pixel input value corresponding to the second sub-pixel in the fourth pixel column comprises: setting the second sub-pixel input value corresponding to the second sub-pixel in the fourth pixel column as the output value of the second sub-pixel in the fourth pixel column.

8. A display substrate, comprising pixel groups repeatedly arranged, each of the pixel groups comprises two first sub-pixels, eight second sub-pixels and two third sub-pixels, and each of the pixel groups comprises four pixel columns;

four second sub-pixels are sequentially arranged in a second pixel column of each of the pixel groups;

four second sub-pixels are sequentially arranged in a fourth pixel column of each of the pixel groups;

one first sub-pixel and one third sub-pixel are sequentially arranged in the first pixel column of each of the pixel groups and one third sub-pixel and one first sub-pixel are sequentially arranged in the third pixel column of each of the pixel groups;

wherein each of the first sub-pixels is disposed so as to correspond to two second sub-pixels in a pixel column adjacent thereto, each of the third sub-pixels is disposed so as to correspond to two second sub-pixels in a pixel column adjacent thereto;

wherein a luminescence center of the first sub-pixel in the first pixel column and a middle point of a connecting line which connects luminescence centers of the first and second ones of the second sub-pixels in the second pixel column are on a same line in a row direction, a luminescence center of the third sub-pixel in the third pixel column and a middle point of a connecting line which connects luminescence centers of the first and second ones of the second sub-pixels in the fourth pixel column are on a same line in the row direction, a luminescence center of the third sub-pixel in the first pixel column and a middle point of a connecting line which connects luminescence centers of the third and fourth ones of the second sub-pixels in the second pixel column are on a same line in the row direction, a luminescence center of the first sub-pixel in the third pixel column and a middle point of a connecting line which connects luminescence centers of the third and fourth ones of the second sub-pixels in the fourth pixel column are on a same line in the row direction.

9. A display apparatus, comprising the display substrate of claim 8.

10. The display substrate of claim 8, wherein when the first sub-pixel and the third sub-pixel are sequentially arranged in the first pixel column of each of the pixel groups and the third sub-pixel and the first sub-pixel are sequentially arranged in the third pixel column of each of the pixel groups, the first sub-pixel in the first pixel column and the third sub-pixel in the third pixel column are in a same pixel row, the third sub-pixel in the first pixel column and the first sub-pixel in the third pixel column are in a same pixel row.

11. A display apparatus, comprising the display substrate of claim 10.

12. A method for driving the display substrate of claim 8, the method comprising steps of:

generating output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups; outputting the output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups.

13. The method of claim 12, wherein the step of generating the output values of the first sub-pixel and the third sub-pixel in the first pixel column, the four second sub-pixels in the second pixel column, the third sub-pixel and the first sub-pixel in the third pixel column and the four second sub-pixels in the fourth pixel column of each of the pixel groups comprises sub-steps of:

generating the output value of the first sub-pixel in the first pixel column in accordance with four first sub-pixel input values corresponding to the first sub-pixel in the first pixel column;

generating the output value of the third sub-pixel in the first pixel column in accordance with four third sub-pixel input values corresponding to the third sub-pixel in the first pixel column;

generating the output value of each of the second sub-pixels in the second pixel column in accordance with the second sub-pixel input value corresponding to the second sub-pixel in the second pixel column;

generating the output value of the third sub-pixel in the third pixel column in accordance with four third sub-pixel input values corresponding to the third sub-pixel in the third pixel column;

generating the output value of the first sub-pixel in the third pixel column in accordance with four first sub-pixel input values corresponding to the first sub-pixel in the third pixel column;

generating the output value of each of the second sub-pixels in the fourth pixel column in accordance with the second sub-pixel input value corresponding to the second sub-pixel in the fourth pixel column.

14. The method of claim 13, wherein, the sub-step of generating the output value of the first sub-pixel in the first pixel column in accordance with the four first sub-pixel input values corresponding to the first sub-pixel in the first pixel column comprises: dividing a sum of the four first sub-pixel input values corresponding to the first sub-pixel in the first pixel column by four to generate the output value of the first sub-pixel in the first pixel column;

the sub-step of generating the output value of the third sub-pixel in the first pixel column in accordance with the four third sub-pixel input values corresponding to the third sub-pixel in the first pixel column comprises: dividing a sum of the four third sub-pixel input values corresponding to the third sub-pixel in the first pixel column by four to generate the output value of the third sub-pixel in the first pixel column;

the sub-step of generating the output value of each of the second sub-pixels in the second pixel column in accordance with the second sub-pixel input value corresponding to the second sub-pixel in the second pixel column comprises: setting the second sub-pixel input value corresponding to the second sub-pixel in the second pixel column as the output value of the second sub-pixel in the second pixel column;

the sub-step of generating the output value of the third sub-pixel in the third pixel column in accordance with the four third sub-pixel input values corresponding to the third sub-pixel in the third pixel column comprises: dividing a sum of the four third sub-pixel input values corresponding to the third sub-pixel in the third pixel column by four to generate the output value of the third sub-pixel in the third pixel column;

the sub-step of generating the output value of the first sub-pixel in the third pixel column in accordance with the four first sub-pixel input values corresponding to the first sub-pixel in the third pixel column comprises: dividing a sum of the four first sub-pixel input values corresponding to the first sub-pixel in the third pixel column by four to generate the output value of the first sub-pixel in the third pixel column;

the sub-step of generating the output value of each of the second sub-pixels in the fourth pixel column in accordance with the second sub-pixel input value corresponding to the second sub-pixel in the fourth pixel column comprises: setting the second sub-pixel input value corresponding to the second sub-pixel in the fourth pixel column as the output value of the second sub-pixel in the fourth pixel column.

* * * * *